United States Patent [19]

Robinson

[11] 4,019,000

[45] Apr. 19, 1977

[54] ELECTRICAL SWITCH WITH CHEMICALLY MILLED CONTACTS

[75] Inventor: James H. Robinson, Elkhart, Ind.

[73] Assignee: CTS Corporation, Elkhart, Ind.

[22] Filed: Dec. 16, 1974

[21] Appl. No.: 532,744

[52] U.S. Cl. ..... 200/11 D; 200/15; 200/254

[51] Int. Cl.[2] ..... H01H 19/58; H01H 1/42

[58] Field of Search ..... 200/11 A, 11 D, 15, 200/16 F, 162, 164, 254, 256, 283

[56] References Cited

UNITED STATES PATENTS

| | | | |
|---|---|---|---|
| 2,604,556 | 7/1952 | Daly et al. | 200/15 |
| 2,988,606 | 6/1961 | Allison | 200/15 X |
| 3,137,778 | 6/1964 | Barr | 200/254 X |
| 3,210,485 | 10/1965 | Ma | 200/11 D |
| 3,219,785 | 11/1965 | Allison | 200/283 |
| 3,525,825 | 8/1970 | Allison | 200/11 D |
| 3,525,826 | 8/1970 | Allison | 200/11 D |
| 3,548,123 | 12/1970 | Allison | 200/254 X |
| 3,571,535 | 3/1971 | Beaver et al. | 200/11 D |

*Primary Examiner*—James R. Scott
*Attorney, Agent, or Firm*—John J. Gaydos

[57] ABSTRACT

A rotary electrical switch is provided of the type that includes a stator body of substantially cylindrical shape having a cylindrical opening coaxially disposed therein. The stator body includes a plurality of electrical contacts embedded in the stator body at circumferentially spaced positions therearound and extending radially inward from the cylindrical opening in the stator body and having a pair of parallel disposed planar contact surfaces, all of the contacts being disposed in a common plane orthogonal to the longitudinal axis of the cylindrical opening. A rotor body is rotatably disposed in the cylindrical opening and a contactor clip including a pair of contactors electrically and resiliently engaging both planar contact surfaces of respective ones of the contacts is constrained to rotate with the rotor body. Each of the electrical contacts includes a pair of wedge-shaped edges for easy entrance of the planar contact surfaces in between the pair of contactors as the rotor is rotated in either direction. The method includes the manufacturing of the electrical switch particularly the manufacture of the electrical contacts and the wedge-shaped surfaces thereon by chemical milling.

5 Claims, 7 Drawing Figures

ELECTRICAL SWITCH WITH CHEMICALLY MILLED CONTACTS

The present invention relates generally to electrical switches, and, more particularly, to electrical switches of the type having a stator body that includes a plurality of planar disposed electrical contacts.

Electrical switches of the rotary type disclosed in the present invention are common to the industry having received wide acceptance in the ratio and television industry. A complete disclosure of the construction and operation of switches of this type was made in U.S. Pat. No. 2,988,606 issuing to Allison and which is of common assignee. Such rotary electrical switches have previously utilized a blanking operation for stamping a plurality of interconnected electrical contacts into a strip of metal. The electrical contacts have been molded into a stator body while still being interconnected and connected to the strip of metal. Subsequently, the electrical contacts have been separated from each other and from the strip of metal by a secondary blanking operation, leaving the separate electrical contacts firmly attached to the stator body.

The use of a punch and die set to blank the electrical contacts has left the usual blanking burr on one surface of each electrical contact; and this burr has been detrimental to the service life of the switch and responsible for poor electrical noise characteristics of the switch. Since switches of this type have commonly been used in television tuners, it has been the usual practice to plate the electrical contacts and the contactor clip where low contact resistance is desired with one of the noble metals, e.g., silver. The blanking burrs on the electrical contacts obviously cause a serious acceleration of wear on the contactor surface especially since the plating of the contacts increases the burr size since plating tends to build up on sharp corners. In addition, the tooling expense for the punch and die set used in blanking the electrical contacts is quite high because of the complexity of a punch and die set that blanks a high number of electrical contacts simultaneously. Not only is the tooling cost high, but also, the lead time for procuring the tooling is quite often excessive. A punch and die set can only be justified when a large number of electrical switches are required by a customer since one punch and die set can make only one type of switch design. Heretofore the manufacture of low quantities of switches of various designs, e.g., with a different number of contacts or poles, has not been made since the customer would not pay the high price per switch. It therefore would be desirable to provide an electrical switch and a method of making switches in which the burrs are eliminated and wedge-shaped edges are provided on the contacts by the use of chemical milling. Moreover, it would be desirable economically to provide a variety of specialized switch designs and to manufacture such switches within relatively short lead times by the use of chemical milling.

Accordingly, it is an object of the present invention to provide an electrical switch in which each of the electrical contacts is provided with a pair of beveled edges to provide easy entrance of the electrical contacts between a pair of contactors.

Another object of the present invention is to provide a method of manufacturing of an electrical switch having a stator body molded to a plurality of electrical contacts in which the burred edge that accompanies a blanking operation of the electrical contacts is obviated.

A further object of the present invention is to provide a method of manufacturing an electrical switch having electrical contacts in which the edges of the contacts are beveled by the same process that cuts the contacts from a strip of metal.

Still another object of the present invention is to provide a method of chemical milling of electrical contacts in which the contacts are cut from a strip of metal and the edges thereof are beveled by chemical milling.

Yet another object of the present invention is to control the process of chemical milling to provide a maximum length to the beveled surfaces.

Further objects and advantages of the present invention will become apparent as the following description proceeds, and the features of novelty characterizing the invention will be pointed out with particularity in the claims annexed to and forming a part of this specification.

Briefly, the present invention relates to an electrical switch provided with a plurality of electrical contacts attached to a stator body and each contact includes a contact finger portion extending away from the stator body. Each of the contact finger portions includes a pair of parallel disposed and planar contact surfaces and all of the contact finger portions lie in a single plane. A contactor clip engages the contact finger portions.

In a specific embodiment the stator body is cylindrical and the contact finger portions extend radially inwardly into an opening provided in the stator body. A substantially cylindrically shaped rotor body of dielectrical material is rotatably disposed in the opening and is coaxially rotatable therein. The contactor clip constrained to rotate with the rotor body is formed from spring type sheet stock and includes a pair of contactors that selectively and resiliently engage both planar contact surfaces of respective ones of the contact finger portions as the rotor is rotated. Each of the contact finger portions includes a first edge surface disposed substantially radially to the longitudinal axis of the stator and that intercepts a first one of the planar contact surfaces at an obtuse angle. In addition, each of the contact finger portions includes a second edge surface disposed substantially radially to the aforesaid longitudinal axis, that intercepts the second of the planar contact surfaces at an obtuse angle, and that intercepts the first edge surface; so that the two edge surfaces cooperate to provide a wedge-shaped edge on the contact finger portion for easy entrance of the contact finger portion in between the pair of contactors. In like manner, each of the contact finger portions includes another pair of edge surfaces that are substantially radially disposed and cooperate to provide a second wedge-shaped edge on the contact finger portion for easy entrance of the contact finger portion in between the pair of contactors when the rotor is rotated in the opposite direction.

The method includes producing an enlarged pattern of interconnected electrical contacts in their respective positions as molded in the stator body by drawing and cutting the enlarged pattern from a plastic sheet of a color to which a photographic film is relatively insensitive, photographically reducing the enlarged pattern to an actual size on a photographic glass plate, producing an actual size negative by contact printing the glass plate onto a photographic film, multiple imagining the pattern on a strip of photographic film, producing a mirror image phototransparency that includes a plurality of mirror image patterns by contact printing onto a strip of duplicating film, placing the two phototransparencies together with the emulsions thereof proximal to each other, positioning the phototransparencies into precise image registry, and fastening one edge of the phototransparencies together to maintain image registry.

The method also includes coating both sides of a strip of metal with a photoresist material, placing the strip of metal between the strip phototransparencies, exposing both strip phototransparencies to ultraviolet light, developing the photoresist material on the strip of metal, and chemically milling the strip of metal. The method further includes molding the stator body to portions of the strip of metal including selective portions of the electrical contacts, and severing the electrical contacts from each other and from the strip of metal by a blanking operation.

For a better understanding of the present invention, reference may be had to the accompanying drawings wherein the same reference numerals have been applied to like parts and wherein.

Figure 1:
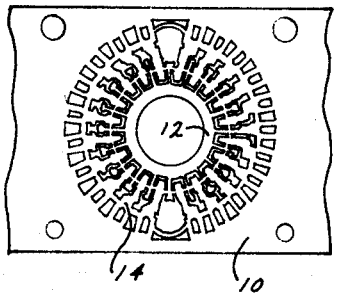
FIG. 1 is a top plan view of a portion of a strip of metal showing a set of electrical contacts that have been formed in the strip.
Figure 2:
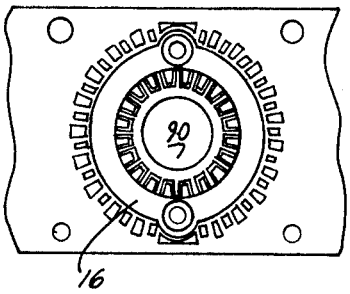
FIG. 2 is a top plan view showing a stator body molded to the set of contacts shown in FIG. 1.
Figure 3:
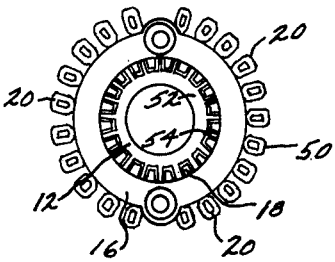
FIG. 3 is a top plan view showing the stator body with the set of contacts embedded therein and severed from the strip of metal shown in FIG. 2.
Figure 5:
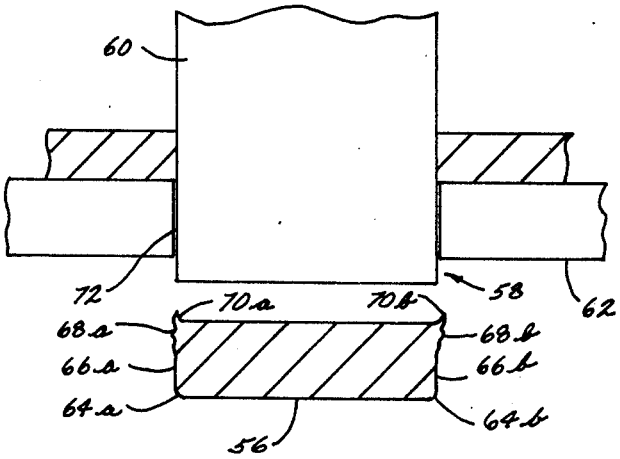
FIG. 5 is a sectional view of the contact finger portion of an electrical contact and a sectional view of a punch and die set for blanking the electrical contact, illustrating the burrs that are formed on a prior art electrical contact by a blanking operation.
Figure 7:
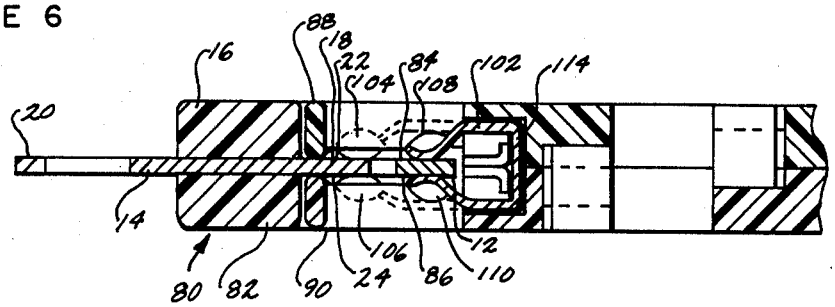
FIG. 7 is a cross-section of the stator body shown in FIG. 3 assembled to a rotor body and a contactor clip.

Referring now to the drawings, and more particularly to FIGS. 1 and 2, a strip of metal 10 includes first and second sets of electrical contacts 12 and 14, which have been formed in the strip 10 and which are both interconnected and connected to the strip 10. A stator body 16 of substantially hollow cylindrical shape has been molded to both sides of portions of the second set of electrical contacts 14. As best seen in FIGS. 3 and 7, each of the electrical contacts 14 includes a contact finger portion 18 extending radially inwardly of the stator body 16 and a wire attaching lug 20 extending radially outwardly of the stator body 16. Each of the contact finger portions 18 includes a pair of planar contact surfaces 22 and 24 (see FIG. 7). With particular reference to FIG. 5, each of the contact finger portions additionally includes a first leading edge surface 26 of the contact finger portion 18 and a second leading edge surface such as second leading edge surface 28 of the contact finger portion 18. The leading edge surface 26 is disposed substantially radially and intercepts the planar contact surface 22 at an obtuse angle as indicated by the angle 30. In like manner, the second leading edge surface 28 is disposed substantially radially and intercepts the second planar contact surface 24 at an obtuse angle as indicated by the angle 32. The second leading edge surface 28 intercepts the first leading edge surface 26 to provide a wedge-shaped edge 34.

In like manner, each of the contact finger portions of the electrical contacts includes another pair of edge surfaces such as the edge surfaces 36 and 38 of the contact finger portion 18 which cooperate to provide a second wedge-shaped edge 40.

Included with each set of electrical contacts 12 and 14 are at least one common terminal such as common terminal 50 of FIG. 3 and one arcuate common contact such as arcuate common contact 52 of FIG. 3. The arcuate common contact 52 is connected to the stator body 16 by support bars such as support bar 54 of FIG. 3. The support bar 54 provides electrical connection between the common terminal 50 and the arcuate common contact 52 and also provides mechanical support between the stator body 16 and the arcuate common contact 52. This general type of construction is fully described in U.S. Pat. No. 2,988,606 of common assignee.

Figure 4:
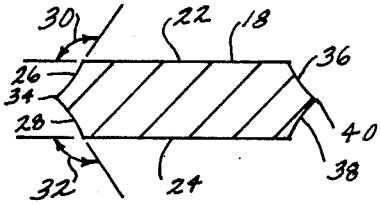
FIG. 4 is a sectional view of a contact finger portion of one of the electrical contacts taken along section line IV—IV of FIG. 6.

Referring now to FIGS. 4 and 5, the advantages of the present invention are readily apparent when the burrless and wedge-shaped edges of the contact finger portion 18 of FIG. 4 are compared to a cross-section of a typical contact finger portion that is fabricated by the usual blanking operation. In FIG. 5, a contact finger portion 56 is shown in cross-section similar to the cross-section of FIG. 4 and is shown in a punch and die set 58 which includes a punch 60 and a die 62. The blanked contact finger portion 56 typically includes a pair of rounded edges 64*a* and 64*b*, a pair of sheared-edge portions 66*a* and 66*b* comprising perhaps a third of the thickness of the contact finger portion 56, a pair of torn-edge portions 68*a* and 68*b*, and a pair of burrs 70*a* and 70*b*, the burrs being formed as a result of the punch clearance 72.

Figure 6:
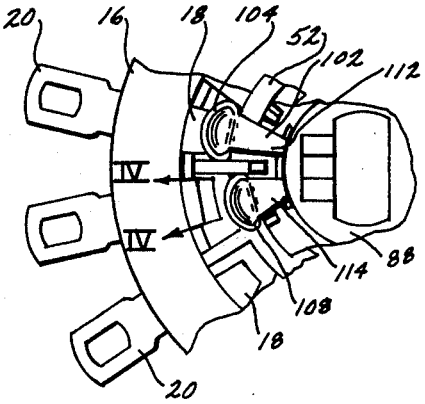
FIG. 6 is a fragmentary section of the stator body shown in FIG. 3 with a contactor clip engaging one of the individual contacts and the common contact.

Referring now to FIGS. 6 and 7, a rotary electrical switch 80 includes a stator assembly 82 having a molded stator body 16, a plurality of individual electrical contacts 14 and a common contact 52. Each of the electrical contacts 14 includes a contact finger portion 18 extending radially inward from the stator body 16 and each of the contact finger portions 18 includes a pair of parallel disposed and planar contact surfaces 22 and 24. The arcuate common contact 52 also includes common contact surfaces 84 and 86. A contactor body or rotor body 88 of insulating material and having a substantially cylindrical shape is coaxially disposed within a cylindrical opening 90 of the stator body 16. Constrained to rotate the rotor body 88 is a contactor clip 102. The contactor clip 102 includes a first pair of electrical contactors 104 and 106 which resiliently and electrically engage respective ones of the planar contact surfaces 22 and 24 of the electrical contacts 14 as the rotor body 88 is rotated to engage selectively the first pair of electrical contactors 104 and 106 with different ones of the electrical contacts 14. The contactor clip 102 also includes a second pair of electrical contactors 108 and 110 which resiliently and electrically engage the common contact surfaces 84 and 86 respectively. The contactor clip 102 includes a first spring portion 112 interconnecting the electrical contactors 104 ad 106 and serving as a resilient means for urging the electrical contactors 104 and 106 into electrical engagement with the planar contact surfaces 22 and 24 respectively. The contactor clip 102 also includes a second spring portion 114 interconnecting the electrical contactors 108 and 110 and serves as a resilient means to urge the electrical contactors 108 and 110 into electrical conducting engagement with the common contact surfaces 84 and 86 respectively. The entire contactor clip 102 is formed from a single piece of sheet metal and the point of interconnection of the contactors 104 and 106 with the contactors 108 and 110 is between the spring portions 112 and 114 as can be seen in FIG. 6.

Thus rotating the rotor body 88 is effective to engage electrically the contactor clip 102 with individual selective ones of the electrical contacts 14 while maintaining electrical contact with the arcuate common contact 52 and the common terminal 50 which is connected thereto.

Referring now to the method, it is an object of the method to cut a plurality of electrical contacts from a strip of metal by chemical milling and to form a wedge-shaped edge on the contacts by the chemical milling process. It will be readily understood by those familiar with the art of chemical milling that longer chemical milling times, stronger chemical milling solutions, high solution temperatures, and various changes in the composition of the strip of metal will alter the length of this wedge-shaped edge. Thus those familiar with the art will be able to optimize the length of the wedge for various types of metals and for various chemical solutions.

It will be further understood by those familiar with the art that the chemical milling process, if allowed to proceed longer than the time that will produce the wedge-shaped edge will, at some length of milling time, produce an edge that approximates a sheared or blanked edge, yet without the burrs which accompany the mechanical shearing or blanking operations. Thus the method of the present invention produces a switch of superior quality even though the chemical milling process is not optimized to produce the wedge-shaped edge.

A typical method of fabrication and the steps thereof are as follows:

a. Cutting or producing an enlarged pattern of the electrical contacts, electrical terminal, and arcuate common contact. This enlarged pattern is customarily made ten times its actual size and it is cut from a plastic material having a red layer and a clear transparent layer, the red layer being removed in areas corresponding to the areas that will subsequently be removed by chemical milling. A commonly used material for the pattern is sold under the trademark Studnite;

b. Reducing the enlarged pattern onto a photographic glass plate whose emulsion is relatively insensitive to the red plastic so that a high-contrast phototransparency is produced having clear areas corresponding to the actual size and shape of the electrical contacts;

c. Reproducing the pattern by contact printing the photographic glass plate onto a photographic film and producing a phototransparency in which the areas representing the electrical contacts are opaque;

d. Reproducing a plurality of the patterns from the photographic film onto a strip of photographic film thereby producing a strip phototransparency having the electrical contacts represented by clear areas of film;

e. Producing a plurality of mirror image patterns from the strip of photographic film by contact printing the strip of film onto a strip of duplicating film and thereby producing a strip phototransparency in which the electrical contacts are also represented by clear areas of film;

f. Superimposing the strip phototransparencies with the emulsions thereof proximal to each other and with the respective images of the patterns in registry;

g. Attaching the strip phototransparencies together at one edge thereof;

h. Coating both sides of a piece of brass strip with a photoresist material. In a preferred process, cartridge brass, comprising approximately 70% copper and 30% zinc, is coated on both sides by pressure and temperature laminating sheets of photoresist material thereto. The brass strip can also be dipped into a photoresist material. Such a photoresist material is sold under the trade name Laminar A Dynachem;

i. Inserting the photoresist coated strip of metal between the phototransparencies;

j. Exposing both transparencies to ultraviolet light having a wave length of substantially 3650 Angstroms, thereby exposing both photoresist coatings to the light in areas corresponding to the electrical contacts, and thereby rendering the light exposed areas insoluble to the developer solution;

k. Developing the light exposed strip in a mild alkaline solution to dissolve the areas of the photoresist material that have not been exposed. A suitable developer is sold under the trade name Dynachem Developer 200P; and the developing process is done at room temperature;

l. Chemically milling the developed strip to open areas therethrough corresponding generally to the dissolved areas of the photoresist coatings. The preferred method utilizes an aqueous solution of cupric chloride having a specific gravity equivalent to 34 on the Baume scale, a temperature of 140° F. and a chemical milling time of approximately eight minutes to produce the optimum length of wedge-shaped edges;

m. Stripping the light exposed portions of photoresist material from the strip. The light exposed portions of the photoresist coatings are soluble in a stronger alkaline solution than that used for the developer. A preferred stripper is sold under the trade name Laminar A Stripper 400K by Dynachem. This stripper is used at 130°–160° F. The red layer can in the alternative represent areas or contacts that will not be removed by chemical milling if an opposite photoresist material is used;

n. Silver plating the strip of metal;

o. Molding the stator body to both sides of the plated strip. A preferred material for the stator body is a glass alkyd material designated as Material 3510 by the American Cyanamid Company; and p. Severing the electrical contacts from each other and from the plated strip by a blanking operation.

While there has been illustrated and described what is at present considered to be a preferred embodiment of the present invention and a method of making the same, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. An electrical switch comprising a stator body of dielectric material, a movable contactor body being movable with predetermined relative motion with respect to the stator body, a plurality of electrical contacts each being fixedly attached to the stator body, the stator body being molded to the electrical contacts, each of the contacts having a planar contact surface in planar alignment with the planar contact surfaces of the other of the electrical contacts, and each of the contacts having a chemically milled leading edge surface that is disposed substantially orthogonal to the direction of motion of the contactor body with respect to the planar surface and that is at an obtuse angle to the planar contact surface thereof, an electrical contactor constrained to move with the contactor body for selectively and slideably engaging the planar contact surfaces, and resilient means urging the electrical contactor into electrical conducting engagement with selective ones of the planar contact surfaces.

2. The electrical switch of claim 1, wherein the relative motion is reversible, and each of the electrical contacts includes a second chemically milled edge surface that serves as a leading edge surface for the reversed relative motion and that is at an obtuse angle to the planar contact surface thereof.

3. The electrical switch of claim 1, wherein each of the electrical contacts includes a second planar contact surface disposed parallel to the first planar contact surface, and each of the electrical contacts includes a second chemically milled leading edge surface intercepting the second planar surface at an obtuse angle and intercepting the first chemically milled leading edge surface to provide a chemically milled wedge-shaped edge, a second electrical contactor is electrically and mechanically attached to the first electrical contactor for selectively and slideably engaging the second planar contact surfaces whereby the wedge-shaped edge facilitates entrance of said electrical contacts in between said contactors.

4. The electrical switch of claim 1, wherein each of said electrical contacts includes a second planar contact surface disposed parallel to the first planar contact surface, a second electrical contactor is integral with the electrical contactor and constrained to move with the contactor body for selectively and slideably engaging the second planar contact surfaces, and the resilient means comprises the contactors preformed from spring type sheet stock providing a spring force urging the contactors toward each other and urging the contactors into resilient engagement with respective ones of the planar contact surfaces.

5. In a rotary electrical switch, the combination of a stator body of substantially cylindrical shape having a substantially cylindrical opening coaxially disposed therein, a plurality of electrical contacts each being attached to the stator body and each including a contact finger portion extending radially inwardly from the cylindrical opening and including a pair of parallel disposed and planar contact surfaces disposed orthogonally to the longitudinal axis of the opening, the stator body being molded to the electrical contacts, a substantially cylindrically shaped rotor body of dielectrical material rotatably disposed into the opening and coaxial therewith, and a contactor clip mechanically engaged with the rotor body to receive rotary motion therefrom and formed from spring type sheet stock and including a pair of contactors that selectively and resiliently engage both of said pair of planar contact surfaces of respective ones of the contact finger portions, the improvement comprising each of the contact finger portions including a first chemically milled edge surface disposed substantially radially to the longitudinal axis and intercepting the first planar surface at an obtuse angle, and each of the contact finger portions including a second chemically milled edge surface disposed substantially radially to the longitudinal axis, intercepting the second planar contact surface at an obtuse angle, and intercepting the first edge surface and providing a chemically milled wedge-shaped edge whereby the wedge-shaped edge facilitates entrance of the contact finger portions between the pair of contactors.

* * * * *